US007191067B1

(12) United States Patent
Berry et al.

(10) Patent No.: US 7,191,067 B1
(45) Date of Patent: Mar. 13, 2007

(54) SYSTEM AND METHOD OF SELECTING A MOTOR FOR A WELLBORE

(75) Inventors: Michael R. Berry, Norman, OK (US); Stephen M. Breit, Edmond, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 75 days.

(21) Appl. No.: 11/134,549

(22) Filed: May 20, 2005

Related U.S. Application Data

(60) Provisional application No. 60/599,804, filed on Aug. 6, 2004.

(51) Int. Cl.
*G06F 19/00* (2006.01)

(52) U.S. Cl. ..... 702/9; 703/10

(58) Field of Classification Search ..... 702/9, 702/6

See application file for complete search history.

(56) References Cited

U.S. PATENT DOCUMENTS 6,023,683 A 2/2000 Johnson et al.
6,138,078 A * 10/2000 Canada et al. ..... 702/44
6,167,388 A 12/2000 Ray
6,206,108 B1 * 3/2001 MacDonald et al. ..... 175/24
6,585,041 B2 * 7/2003 Crossley ..... 166/53
6,662,062 B1 12/2003 Bjornson et al.
6,701,298 B1 3/2004 Jutsen

* cited by examiner

*Primary Examiner*—Donald McElheny, Jr.
(74) *Attorney, Agent, or Firm*—Crowe & Dunlevy, P.C.

(57) ABSTRACT

A system for determining the ability of a selected motor to function in a wellbore preferably includes an input device, a data storage device and a program. The program is preferably configured to determine an expected motor load based on motor input data and application input data. Using the expected motor load, the program determines a projected motor temperature increase. The program adds the projected motor temperature increase with the wellbore temperature to determine a projected operating temperature. The projected operating temperature is compared with the maximum recommended operating temperature of the selected motor, or a list of candidate motors, to determine the ability of the selected motor to function in the wellbore.

19 Claims, 4 Drawing Sheets

SYSTEM AND METHOD OF SELECTING A MOTOR FOR A WELLBORE

RELATED APPLICATIONS

This application claims the benefit of U.S. Provisional Patent Application No. 60/599,804, entitled Motor Rating Analysis Process Application, filed Aug. 6, 2004, which is herein incorporated by reference.

FIELD OF THE INVENTION

This invention relates generally to the field of downhole pumping systems, and more particularly to an automated system and method for analyzing motors for downhole applications.

BACKGROUND

Submersible pumping systems are often deployed into wells to recover petroleum fluids from subterranean reservoirs. Typically, a submersible pumping system includes a number of components, including one or more electric motors coupled to one or more pump assemblies. The selection of an appropriate motor for a downhole application depends on analysis of the ambient downhole conditions and the motor characteristics.

The power delivered by an electric motor is limited by a number of factors, including its internal temperature. The ambient conditions in a wellbore have a significant impact on the internal temperature of the motor and on the proper selection of the motor. Application engineers have typically been tasked to manually calculate power capacity, loads, voltage drops, heat rises, heating effects, flow rates and other parameters that influence the selection of a motor for downhole applications. The manual calculation of these factors is time consuming and error prone, and is frequently skewed by improper understanding of wellbore conditions. Selection of an improper motor for a particular application can result in a shortened motor life and excessive expenses associated with replacing the motor. As such, designers significantly "oversize" a motor for a given application to ensure adequate durability. Oversized motors tend to be more expensive, thereby adding unnecessary costs to the deployment. It is to these and other deficiencies in the prior art that the present invention is directed.

SUMMARY OF THE INVENTION

In a preferred embodiment, the present invention includes a system for determining the ability of a selected motor to function in a wellbore. The system preferably includes an input device, a data storage device and a program. The program is preferably configured to determine an expected motor load based on motor input data and application input data. Using the expected motor load, the program determines a projected motor temperature increase. The program adds the projected motor temperature increase with the wellbore temperature to determine a projected operating temperature. Once the projected operating temperature is determined, the ability of the selected motor to function in the wellbore is evaluated by comparing the projected operating temperature with the maximum recommended operating temperature of the selected motor.

DETAILED DESCRIPTION OF A PREFERRED EMBODIMENT

Figure 1:
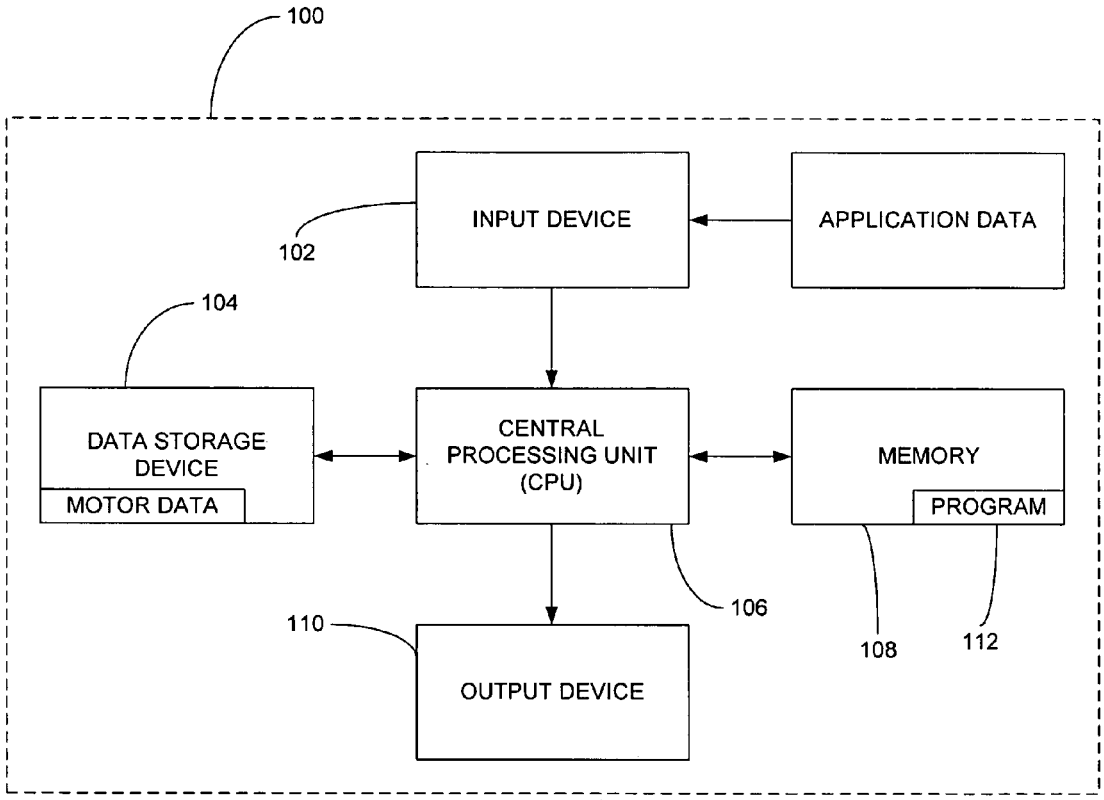
FIG. 1 is functional block diagram of a motor selection system constructed in accordance with a preferred embodiment of the present invention.

In a preferred embodiment, the present invention includes a computerized system 100 for selecting a motor for use in an oil or gas well. As shown in FIG. 1, the system 100 preferably includes an input device 102, a data storage device 104, a central processing unit (CPU) 106, memory 108 and an output device 110. In a particularly preferred embodiment, the system 100 is incorporated within a personal computer (PC) or a network of personal computers. For example, it may be desirable to locate the data storage device 104 at a central database that can be conveniently accessed by a plurality of networked computers.

Continuing with FIG. 1, the memory 108 is preferably connected to the CPU 106 and used to store a program 112. As disclosed in greater detail below, the program 112 is preferably configured to control the motor selection process. The program 112 can be constructed using a computer spreadsheet program, such as Microsoft Excel®, or an object oriented computer programming language, such as Microsoft Visual Basic®. It will be understood that, as used herein, the term "program" refers generally to the computerized functionality of the motor selection system 100. As such, the program 112 may include separable or independent programs directed to particular aspects of the motor selection system 100. It will also be understood that some, or all, of the program 112 may be stored in different locations within the system 100.

The data storage device 104 preferably serves as a database for the storage and recall of information and data used by the system 100. For example, data pertaining to available downhole motors is preferably stored in the data storage device 104 for convenient recall during operation of the system 100. The input device 102 is preferably configured as a computer keyboard that can be used to enter application data into the system 100. The output device 110 is preferably configured as a computer monitor for displaying the output generated by the system 100 to a user. Other output devices, such as printers or communications modules, may optionally be included.

Figure 2:
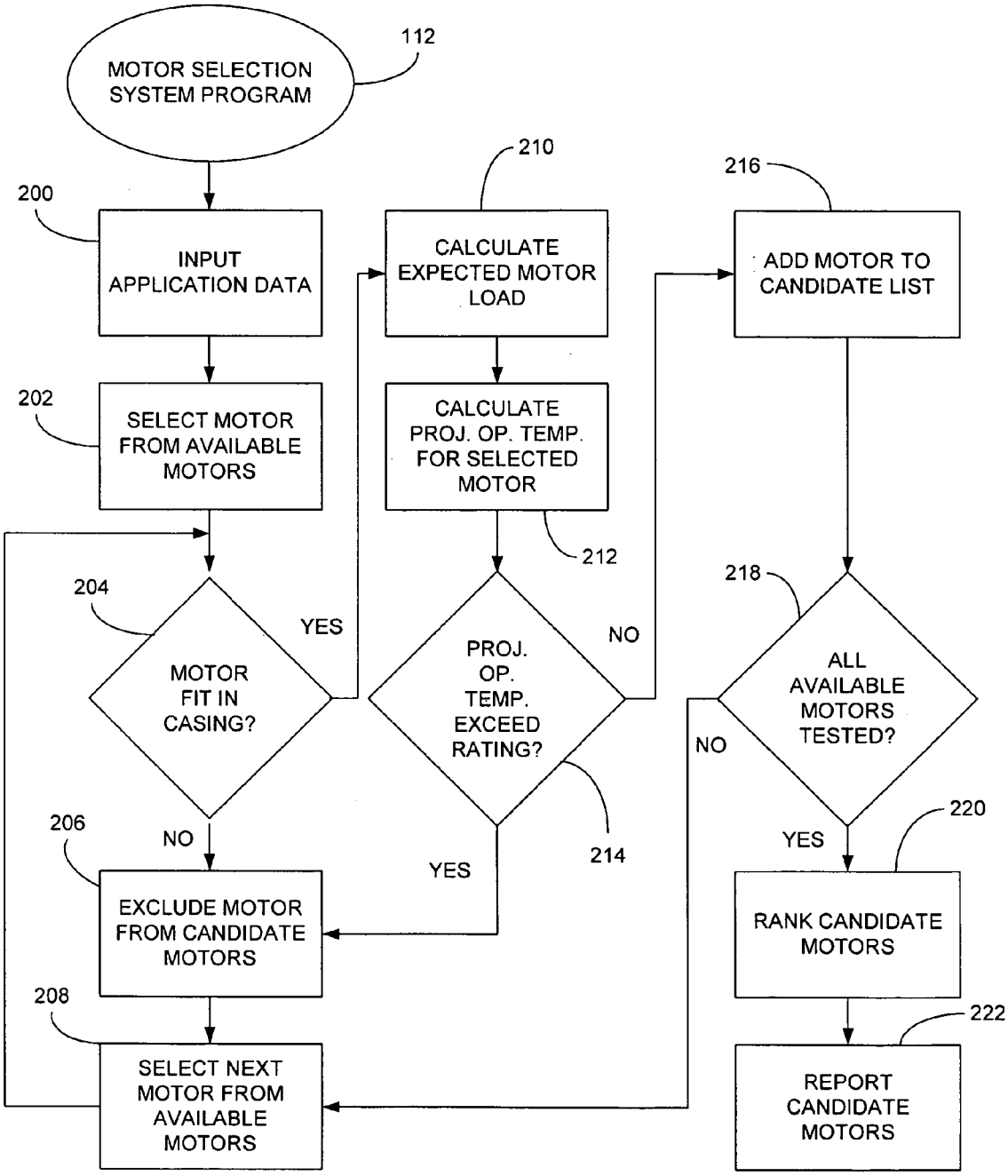
FIG. 2 is a process flow diagram for a method of deriving a correlation between a projected operating temperature and expected motor load.

Turning to FIG. 2, shown therein is a process flow diagram of a presently preferred embodiment of the motor selection system 100, in accordance with the execution of the program 112 by the CPU 106. For the purposes of this disclosure, the execution of the program 112 will be described in terms of its step-wise progression, while making reference to subroutines or external actions that are not necessarily conducted in real-time as the program 112 progresses. For example, certain static motor information is preferably derived and stored in the data storage device 104 before the program 112 is executed.

Given specific information about a particular downhole application ("Application Data"), the program 112 is generally designed to analyze a pool of available motor models and automatically provide a list of candidate motors that are capable of successfully performing under the given conditions. As used herein, the term "Application Data" refers to information entered into the system 100 about the particular downhole application, including fluid properties, motor controller type, wellbore temperature, wellbore casing size, wellbore depth, motor work requirements, cost parameters and additional dynamic, application-specific data. In contrast, the term "Motor Data" as used herein refers to information stored in the data storage device 104 that relates to the selected motor or model of motor, which can include operating frequency, motor size and geometry, nameplate motor power rating, nameplate motor efficiency, maximum recommended operating temperature, and certain correction factors and constants used during calculations made by the program 112.

Beginning at process flow diagram block 200, the program prompts the user to enter the specified application data. The requested application data may include: wellbore temperature, well pressure, oil flow rate, oil specific gravity, water flow rate, water cut (water-to-oil ratio), water specific gravity, gas flow rate, gas specific gravity, casing size and geometry, switchboard/controller identity or preference, preferred operating frequency and scaling reports. At block 202, the program 112 accesses the data storage device 104 and selects a first motor to analyze from a pool of "available motors." At the time the first motor is selected, the program 112 preferably retrieves the associated Motor Data from the data storage device 104.

At block 204, the program 112 compares the size of the selected motor to the size of the wellbore. More specifically, the program compares the outer diameter of the selected motor with the inner diameter of the wellbore casing. If the motor will not fit within the wellbore casing, the selected motor is excluded from the list of candidate motors at block 206. At block 208, the program 112 selects another motor model from the list of available motors and returns to block 204.

If the selected motor is compatible with the dimensions of the wellbore, the program calculates an Expected Motor Load at step 210. The Expected Motor Load, or "nameplate load fraction," is preferably based on the amount of work required by the application (motor output requirement) and the nameplate power rating of the selected motor (motor power rating). In a particularly preferred embodiment, the Expected Motor Load (EML) is determined according to the following equation:

$$\text{EML}=(\text{motor output requirement})/(\text{motor power rating}) \qquad \text{Eq. 1}$$

If an operating frequency other than the motor data reference frequency (typically 50 Hz or 60 Hz) is selected, the Expected Motor Load is preferably adjusted by multiplying the motor output requirement by the quotient of the reference frequency over the selected frequency. If more than one motor are being considered, i.e., a tandem configuration, the motor output requirement is preferably divided by the number of motors in the multiple-motor configuration.

After determining the Expected Motor Load, the program 112 determines a Projected Operating Temperature for the selected motor at block 212. The Projected Operating Temperature is preferably calculated according to the following formula:

$$\text{OperTemp}=(\text{ProjTempIncrease})(\text{CorrFactors})+\text{HotSpotAllowance}+\text{WellTemp} \qquad \text{Eq. 2}$$

Thus, the Projected Operating Temperature (OperTemp) can be calculated by adding the Projected Motor Temperature Increase (ProjTempIncrease) to the wellbore temperature (WellTemp). A Hot Spot Allowance factor (HotSpotAllowance), preferably 35° F., can optionally be summed with the Projected Motor Temperature Increase to provide a margin of error. The Correction Factors (CorrFactors) preferably include corrections for some, or all, of the following: motor efficiency, motor power factor, motor controller, voltage imbalance, fluid velocity, specific heat and scale accumulation. The determination and application of these Correction Factors is described below.

In the presently preferred embodiment, the Projected Motor Temperature Increase is calculated by deriving a correlation between an increase in the internal temperature of a particular motor and the load exerted on the motor. In a particularly preferred embodiment, this correlation is determined empirically through model testing and stored in the data storage device 104 for subsequent retrieval. As explained below, testing is preferably also used to calculate the correction factors for motor efficiency and power factor.

Figure 3:
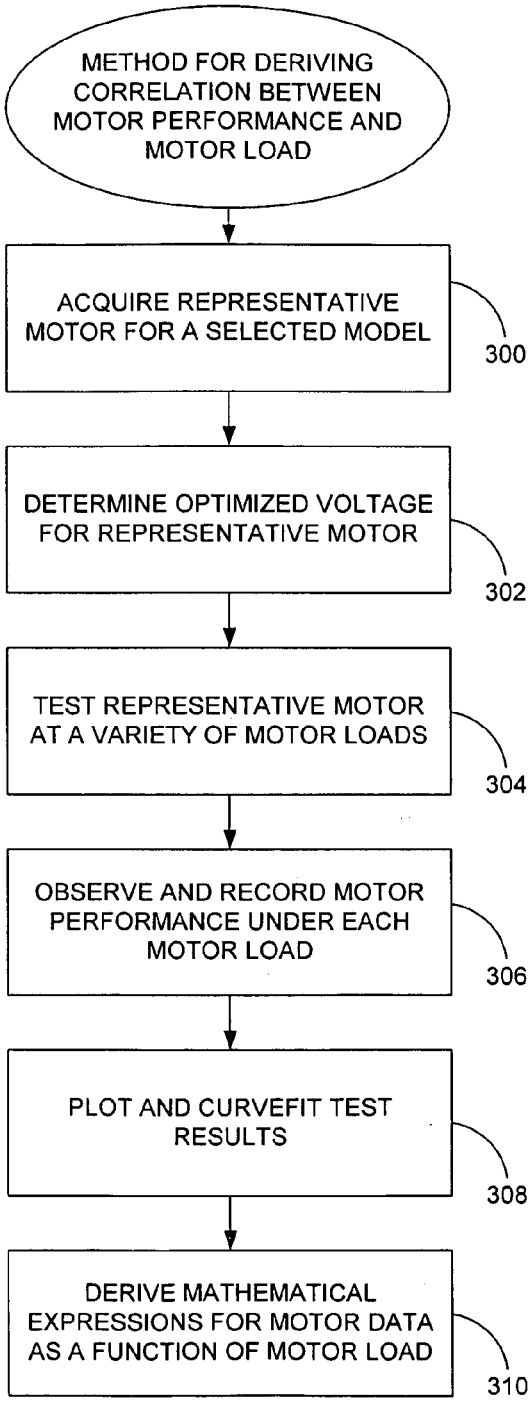
FIG. 3 is a graphical representation of the voltage optimization step of the process shown in FIG. 2.

Turning to FIG. 3, shown therein is a process flow diagram for deriving correlations between motor performance characteristics, such as Projected Motor Temperature Increase, as a function of motor load. At block 300, a representative motor for the selected motor model is acquired. At block 302, an optimized voltage for the representative motor is determined. The optimized voltage is the voltage at which motor current is minimized for a given load. The optimized voltage is preferably determined by operating the representative motor at a variety of motor loads while applying a range of voltages to the motor at each motor load tested. Because operating temperature is generally proportional to voltage, minimizing the current applied to the motor reduces the operating temperature.

Figure 4:
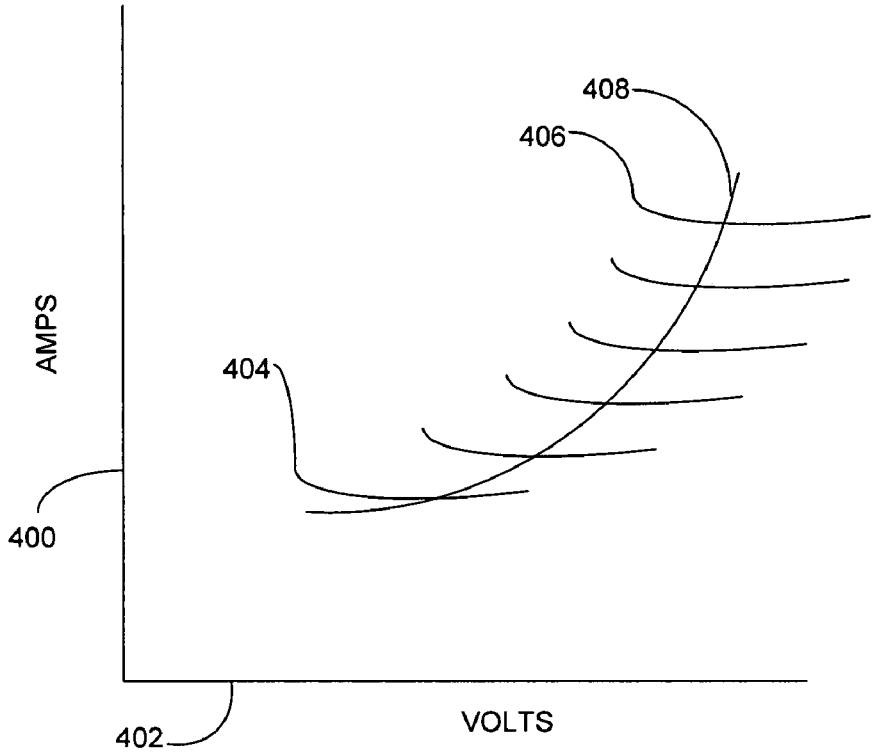
FIG. 4 is a graphical representation of current, voltage, power factor, efficiency, revolutions per minute ("RPM"), and temperature rise, all as a function of motor load for the process of FIG. 2.

Referring now also to FIG. 4, shown therein is a graphical representation of the results of the voltage optimization process. The current 400 is plotted against voltage 402 for a number of test loads, typically ranging from twenty percent 404 to two hundred percent 406 (by a specified increment) of the maximum rated load for the representative motor. At each test load, a range of voltages are applied and the resulting current is recorded. The minimum value of current recorded for each test load generally corresponds to an optimized voltage. A curve 408 is preferably fit through each of the minimum voltages. A trendline or regression can then be used to generate a voltage optimization equation that expresses optimal voltage for the representative motor as a function of motor load. The voltage optimization equation for the representative motor is preferably stored in the data storage device 104 and made accessible for use while analyzing other motors of the same or like model.

Referring to FIG. 3, once the optimized voltage has been determined, the representative motor is tested under a variety of motor loads using the optimized voltage at block 304 in FIG. 3. The test is preferably performed in a "test well" under controlled conditions. At block 306, various performance parameters are observed and recorded for each motor load tested. In a particularly preferred embodiment, the electric current, motor temperature increase, voltage, power factor, revolutions-per-minute (RPM) and motor efficiency are observed and recorded as a function of motor load. At blocks 308 and 310, the results of the tests are plotted, analyzed and used as the basis for equations that correlate performance parameters as a function of motor load.

Figure 5:
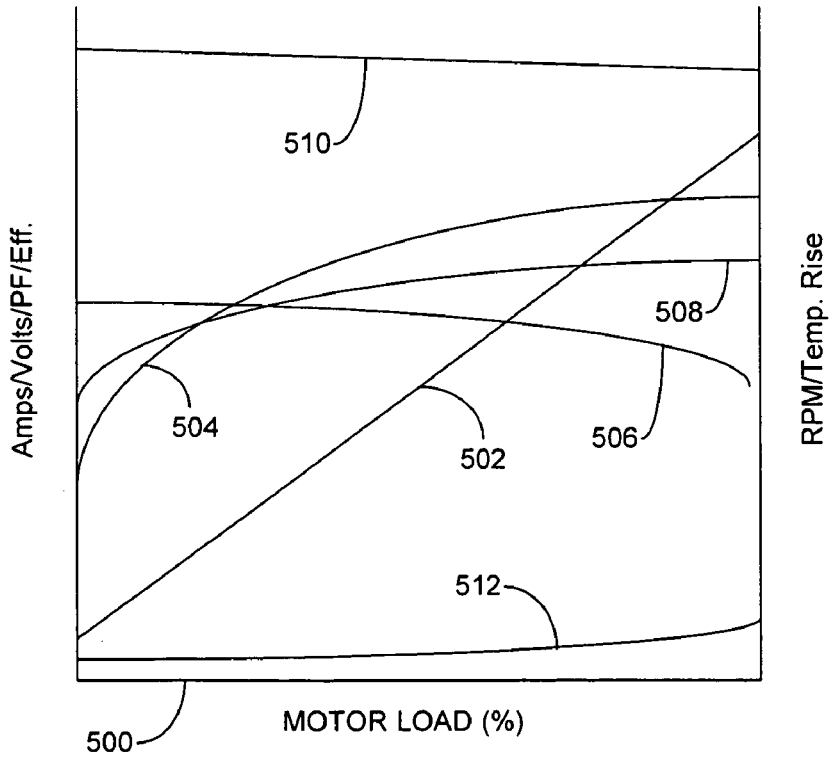
FIG. 5 a process flow diagram for a method of determining a projected operating temperature based on expected motor load and application data.

Turning now to FIG. 5, shown therein is a graphical representation of the test data from block 308 of FIG. 3, as a function of nameplate load fraction 500. Curves for current 502, voltage 504, power factor 506, efficiency 508, RPM 510, and temperature rise 512 are plotted against load fraction 500. Trendlines or regressions can be used to generate equations that express these performance parameters as a function of motor load or nameplate load fraction.

In a particularly preferred embodiment, the trendlines are used to generate polynomials that express the performance parameters as a function of nameplate load fraction. For example, the temperature rise trendline 512 can be used to derive a polynomial that expresses the Projected Motor Temperature Increase term of Eq. (2) as follows:

$$(\text{ProjTempIncrease})=C_0+(C_1)(\%\ \text{Load})+(C_2)(\%\ \text{Load}^2)+(C_3)(\%\ \text{Load}^3)+(C_4)(\%\ \text{Load}^4)+(C_5)(\%\ \text{Load}^5) \quad \text{Eq. 3}$$

Similarly, the trendline for motor efficiency 508 and the trendline for power factor 506 are preferably used to create mathematical expressions for the motor efficiency correction factor (TCFeff) and power factor correction factor (TCFpf), respectively, according to the following equations:

$$\textit{Eq. 4:}\quad TCFeff=\frac{BaseEff}{C_0+C_1\times\%\ \text{Load}+C_2\times\%\ \text{Load}^2+C_3\times\%\ \text{Load}^3+C_4\times\%\ \text{Load}^4+C_5\times\%\ \text{Load}^5}$$

$$\textit{Eq. 5:}\quad TCFpf=\frac{BasePF}{C_0+C_1\times\%\ \text{Load}+C_2\times\%\ \text{Load}^2+C_3\times\%\ \text{Load}^3+C_4\times\%\ \text{Load}^4+C_5\times\%\ \text{Load}^5}$$

The base efficiency in Eq. 4 is the nameplate efficiency at 100% load and the base power factor in Eq. 5 is the nameplate efficiency at 100% load. Efficiency (TCFeff) and power factor (TCFpf) should equal one (1) if the motor is operated at optimal voltage. Accordingly, these factors should only be used if the motor is used at a non-optimal voltage.

The mathematical expressions and coefficients used to generate the Projected Temperature Motor Increase (Eq. 3), the motor efficiency correction factor (Eq. 4) and the power factor correction factor (Eq. 5) are preferably associated with the model of the representative motor and stored in the data storage device 104 for subsequent use during the analysis of like motors.

Figure 6:
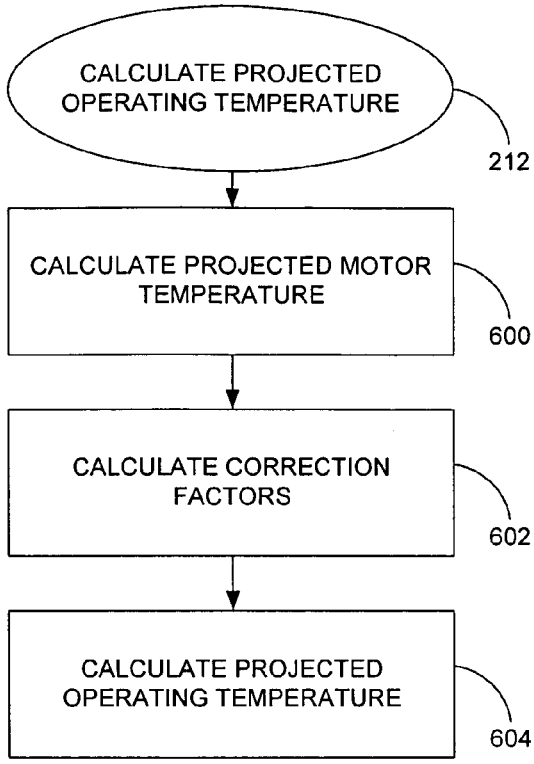
FIG. 6 is a process flow diagram for a motor selection method based on projected operating temperatures and application data.

Turning back to FIG. 2, a Projected Operating Temperature can be determined in accordance with Eq. 2 based on the expressions for Projected Motor Temperature Increase, the Correction Factors, the wellbore temperature and the specified hot spot allowance. The determination of the Projected Operating Temperature is illustrated in the process flow diagram of FIG. 6. At block 600, the Projected Motor Temperature Increase is calculated in accordance with Eq. 3. The (% Load) variable is substituted with the Expected Motor Load value derived from Eq. 1. The coefficients for the Projected Motor Temperature Increase polynomial are preferably model-specific and automatically retrieved from the data storage device 104. The Projected Motor Temperature Increase value is representative of the expected increase in the internal temperature of the selected motor at the Expected Motor Load.

At block 602, the Correction Factors (CorrFactors) of Eq. 2 are calculated. The Correction Factors preferably include one or more of the following correction factors: the motor efficiency factor, the motor power factor, the motor controller factor, the voltage imbalance factor, the fluid velocity factor, the specific heat factor and the scale factor.

As set forth above, the motor efficiency correction factor (TCFeff) and the motor power correction factor (TCFpf) are calculated in accordance with Eq. 3 and Eq. 4, respectively. The (BaseEff) variable and the (BasePF) variable of Eq. 3 and Eq. 4, respectively, are both set to the nameplate efficiency of the selected motor. The nameplate efficiency and the coefficients for correction factor equations are preferably retrieved from the data storage device 104 at the time the motor is selected.

The motor controller correction factor takes into account motor heating as a result of the control panel. The motor controller correction factors are preferably stored in the data storage device 104 and retrieved by the program 112 at block 602. These control panel correction factors are preferably determined on empirical comparisons of motor heating and the use of particular control panels.

The current imbalance correction factor is preferably calculated as a function of voltage imbalance. Current imbalance is well known in the petroleum industry to be a function of the voltage imbalance as in Eq. 6 as follows:

$$\text{CurrentImbalance}=\text{VoltageImbalance}\times 3.92 \quad \text{Eq. 6}$$

The current imbalance correction factor attributable to current imbalance has been found through testing of a particular motor to follow the relationship shown in Eq. 7 as follows:

$$TCFci=1+2.050626\times\text{CurrentImbalance}+2.079623\times\text{CurrentImbalance}^2+2.800654\times\text{CurrentImbalance}^3 \quad \text{Eq. 7}$$

This relationship varies from motor to motor but is readily calculated by voltage imbalance measurements and by solving the respective polynomials.

Fluid velocity correction factors for water and oil take into account the cooling effect of the wellbore fluids passing by the motor. The fluid velocity correction factors for water and oil can be determined according to the following two equations:

$$TCFwtr=1.96-3.72\times Vel+5.78\times Vel^2-4.43\times Vel^3+1.66\times Vel^4-0.25\times Vel^5 \quad \text{Eq. 8}$$

$$TCFoil=1.45-2.53\times Vel-3.78\times Vel^2+2.25\times Vel^3-0.54\times Vel^4-0.04\times Vel^5 \quad \text{Eq. 9}$$

It should be noted that each of the factors used in the Correction Factor of Eq. 2 can be set to one (1) if measurements or wellbore parameters are not readily known. Otherwise, the selected correction factors are multiplied together to produce the Correction Factor of Eq. 2 at block 602 of FIG. 6.

Next, at block 604, the Projected Operating Temperature is calculated according to Eq. 2, reproduced below, by summing the Wellbore Temperature, the Hot Spot Allowance and the product of the Projected Temperature Increase and the Correction Factors.

$$\text{OperTemp}=(\text{ProjTempIncrease})(\text{CorrFactors})+\text{HotSpotAllowance}+\text{WellTemp} \quad \text{Eq. 2}$$

Turning back to FIG. 2, after calculating the Projected Operating Temperature at block 212 of FIG. 2, the program 112 proceeds to block 214 where the Projected Operating Temperature is compared against the maximum recommended operating temperature for the selected motor. If the Projected Operating Temperature is greater than the maximum recommended operating temperature, the selected motor is excluded from the candidate motor list at block 206. If the Projected Operating Temperature is less than, or equal to, the maximum recommended operating temperature, the selected motor is added to the candidate motor list at block 216.

At block 218, the program 112 queries if all available motors have been analyzed. If there are additional available motors, the program returns to block 208 and another motor is selected for analysis. If all of the available motors have been analyzed, the program 112 proceeds to block 220 where the candidate motors are ranked. In a presently preferred embodiment, the candidate motors are ranked according to Expected Motor Load. In most cases, a more cost-effective solution can be designed by using a motor that is projected to perform near its nameplate motor power rating. In alternate embodiments, the candidate motors are ranked according to motor availability, motor price or delivery schedules. The program 112 of the motor selection system 100 ends at block 220 by reporting the ranked candidate motors to the user through the output device 110.

In yet another alternate preferred embodiment, the candidate motors are provided in a tabular presentation, as shown in the motor cross-reference table below.

| | Motor "A" | | | | | | | | | | | | | | |
|---|---|---|---|---|---|---|---|---|---|---|---|---|---|---|---|
| | 100% Rating | | | | | 75% Rating | | | | | 50% Rating | | | | |
| | Freq. | Eff. | PF | RPM | dT (° F.) | Freq. | Eff. | PF | RPM | dT (° F.) | Freq. | Eff. | PF | RPM | dT (° F.) |
| | 60 Hz | 80% | 81% | 3000 | 45 | 60 Hz | 75% | 79% | 3100 | 40 | 60 Hz | 70% | 77% | 3200 | 35 |
| | 50 Hz | 80% | 81% | 2100 | 40 | 50 Hz | 75% | 79% | 2200 | 35 | 50 Hz | 70% | 77% | 2300 | 28 |
| | Motor Length | | | | | | | | | | | | | | |
| | 60 Hz HP | 50 Hz HP | 60 Hz Volts | 50 Hz Volts | Amps | 60 Hz HP | 50 Hz HP | 60 Hz Volts | 50 Hz Volts | Amps | 60 Hz HP | 50 Hz HP | 60 Hz Volts | 50 Hz Volts | Amps |
| 5.0(i) | 20.0 | 16.0 | 300 | 250 | 50 | 15.0 | 12.0 | 275 | 240 | 38 | 10.0 | 8.0 | 250 | 220 | 30 |
| 5.0(ii) | 20.0 | 16.0 | 450 | 400 | 30 | 15.0 | 12.0 | 435 | 360 | 25 | 10.0 | 8.0 | 350 | 300 | 20 |
| 5.0(iii) | 20.0 | 16.0 | 770 | 720 | 15 | 15.0 | 12.0 | 725 | 615 | 14 | 10.0 | 8.0 | 650 | 550 | 11 |
| 5.0(iv) | 20.0 | 16.0 | 1100 | 950 | 10 | 15.0 | 12.0 | 980 | 828 | 10 | 10.0 | 8.0 | 900 | 750 | 5 |
| 10.0(i) | 30.0 | 25.0 | 600 | 550 | 51 | 20.0 | 16.0 | 305 | 250 | 50 | 15.0 | 12.0 | 275 | 240 | 38 |
| 10.0(ii) | 30.0 | 25.0 | 750 | 700 | 31 | 20.0 | 16.0 | 440 | 400 | 30 | 15.0 | 12.0 | 435 | 360 | 25 |
| 10.0(iii) | 30.0 | 25.0 | 1050 | 1000 | 15 | 20.0 | 16.0 | 750 | 720 | 15 | 15.0 | 12.0 | 725 | 615 | 14 |
| 10.0(iv) | 30.0 | 25.0 | 1300 | 1250 | 12 | 20.0 | 16.0 | 1250 | 950 | 10 | 15.0 | 12.0 | 980 | 828 | 10 |
| 15.0(i) | 40.0 | 33.0 | 660 | 610 | 50 | 30.0 | 25.0 | 610 | 550 | 49 | 20.0 | 16.0 | 300 | 250 | 50 |
| 15.0(ii) | 40.0 | 33.0 | 800 | 750 | 30 | 30.0 | 25.0 | 760 | 700 | 35 | 20.0 | 16.0 | 450 | 400 | 30 |
| 15.0(iii) | 40.0 | 33.0 | 1100 | 1050 | 15 | 30.0 | 25.0 | 1055 | 1000 | 16 | 20.0 | 16.0 | 770 | 720 | 15 |
| 15.0(iv) | 40.0 | 33.0 | 1350 | 1250 | 10 | 30.0 | 25.0 | 1250 | 1250 | 12 | 20.0 | 16.0 | 1100 | 950 | 10 |

In many cases, the available motors are capable of being manufactured at various lengths or are configured to be "stacked" together to provide additional output capacity. Additionally, a plurality of winding configurations can be used for each motor to adjust the operating characteristics. For example, in the motor cross-reference table, a motor series "A" is shown in three lengths (5, 10 and 15 ft) with four winding configurations at each length (i–iv). For each length and winding configuration, a different amount of amperage is applied at the optimal voltage to produce the stated output. In the cross-reference table shown above, values for both 60 Hz and 50 Hz operating frequency are provided.

The motor cross-reference table provides a convenient comparison of a number of motor characteristics, including the output capacity (HP), efficiency (Eff.) and projected temperature increase (dT) for motors of varying length and winding configuration when operated at specified loads (i.e., 100% to 50% of nameplate load). For a given motor output requirement, the table provides several solutions for comparison. For example, a 20 HP motor output requirement can be satisfied by using a 5 ft. motor operated at 100% efficiency with a projected temperature increase (dT) of 45° F. or a 10 ft. motor operated at 75% efficiency with a projected temperature increase of 40° F.

This tabular presentation of the output of the system 100 is especially useful for field personnel when discussing purchase options with customers. It will be understood that the motor cross-reference table provided above is merely illustrative of a preferred format and is not to be construed as limiting. Additional or alternative information might also be provided in the motor cross-reference table.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A system for determining the ability of a selected motor to function in a wellbore having known wellbore characteristics, wherein the selected motor has a recommended maximum operating temperature, and wherein the system comprises:

an input device;

a data storage device;

a program resident within the system, wherein the program is configured to:

determine an expected motor load based on motor input data and application input data;

determine a projected motor temperature increase based on the expected motor load;

determine a projected operating temperature by adding the projected motor temperature increase to the wellbore temperature;

determine the ability of the selected motor to function in the wellbore by comparing the projected operating temperature with the maximum recommended operating temperature of the selected motor; and generate output reflective of the comparison between the projected operating temperature with the maximum recommended operating temperature of the selected motor; and an output device that displays the output from the program.

2. The system of claim 1, wherein the motor input data includes a motor power rating obtained from the data storage device and the application input data includes a motor output requirement obtained from the input device, and wherein the expected motor load is determined by dividing the motor output requirement by the motor power rating.

3. The system of claim 1, wherein the program determines the projected motor temperature increase by applying the expected motor load to a correlation between internal motor temperature and motor load for the selected motor.

4. The system of claim 3, wherein the program applies a correction factor to the projected motor temperature increase.

5. The system of claim 1, wherein the program determines the projected operating temperature by adding the sum of the projected motor temperature increase and wellbore temperature to a hot spot allowance.

6. The system of claim 1, wherein the program is further configured to automatically analyze a plurality of available motors and prepare a list of candidate motors that are capable of functioning in the wellbore given the motor power requirement.

7. The system of claim 6, wherein the program ranks the candidate motors based on expected motor load.

8. The system of claim 6, wherein the program ranks the candidate motors based on price.

9. The system of claim 6, wherein the program ranks the candidate motors based on delivery schedules.

10. The system of claim 1, wherein the program is further configured to automatically analyze a plurality of available motors and prepare a motor comparison table of candidate motors that are capable of functioning in the wellbore given the motor power requirement.

11. A method of preparing a list of candidate motors capable of functioning in a wellbore with known wellbore characteristics, wherein a motor has a maximum recommended operating temperature, the method comprising the steps of:

determining an expected motor load by dividing a motor power requirement by a motor power rating;

determining a projected motor temperature increase based on the expected motor load and a correlation between changes in the internal temperature of the motor with motor loads;

determining a projected operating temperature by adding the projected motor temperature increase to the wellbore temperature;

determining the ability of the motor to function in the wellbore by comparing the projected operating temperature with the maximum recommended operating temperature of the motor; and adding the motor to the list of candidate motors if the motor is capable of functioning in the wellbore.

12. The method of claim 11, wherein the step of determining a projected motor temperature increase further comprises the steps of:

operating the motor with a plurality motor loads;

measuring changes in the internal temperature of the motor while the motor is operated with each of the plurality of motor loads;

correlating changes in the internal temperature of the motor with each of the plurality motor loads; and determining a projected temperature increase at the expected motor load based on the correlation between the internal temperature of the motor and the motor load.

13. The method of claim 12, wherein the method further comprises a step of applying a correction factor to the projected motor temperature increase, wherein the correction factor is selected from the group of correction factors consisting of: a motor efficiency correction factor, a motor power correction factor, a motor controller correction factor and a voltage imbalance correction factor.

14. The method of claim 12, wherein the method further comprises a step of applying a correction factor to the projected motor temperature increase, wherein the correction factor is selected from the group of correction factors consisting of: a fluid velocity correction factor, a specific heat correction factor and a scale correction factor.

15. A system for selecting a motor for use with an expected motor load in a wellbore having a known wellbore temperature, wherein the motor has a maximum operating temperature, the system comprising:

an input device;

a data storage device;

a program resident within the system, wherein the program is configured to perform the steps of:

operating the motor with a plurality of motor loads;

measuring changes in the internal temperature of the motor while the motor is operated with each of the plurality of motor loads;

correlating changes in the internal temperature of the motor with each of the plurality of motor loads;

determining a projected temperature increase at the expected motor load based on the correlation between the internal temperature of the motor and the motor load;

determining the projected operating temperature by adding the projected motor temperature increase to the wellbore temperature;

comparing the projected operating temperature for the motor with the maximum operating temperature for the motor; and generating output reflective of the comparison of the projected operating temperature with the maximum operating temperature for the motor; and an output device that displays the output from the program.

16. The system of claim 15, wherein the step of operating the motor with a plurality motor loads further comprises operating the motor with optimized voltages for each of the plurality of motor loads, wherein the optimized voltages are determined by finding the lowest current requirement for a range of voltages at each of the plurality of motor loads.

17. The system of claim 16, wherein the program is further configured to perform a step of applying a correction factor to the projected motor temperature increase, wherein the correction factor is selected from the group of correction factors consisting of: a motor efficiency correction factor, a motor power correction factor, a motor controller correction factor and a voltage imbalance correction factor.

18. The system of claim 16, wherein the program is further configured to perform a step of applying a correction factor to the projected motor temperature increase, wherein the correction factor is selected from the group of correction factors consisting of: a fluid velocity correction factor, a specific heat correction factor and a scale correction factor.

19. The system of claim 15, wherein the step of determining a projected operating temperature further comprises adding a hot spot allowance to the sum of the projected motor temperature increase and the wellbore temperature.

* * * * *